US008120446B2

(12) United States Patent
Tomaki et al.

(10) Patent No.: US 8,120,446 B2
(45) Date of Patent: Feb. 21, 2012

(54) ELECTRONIC COMPONENT

(75) Inventors: Shigemitsu Tomaki, Tokyo (JP); Noriaki Ootsuka, Tokyo (JP); Yoshikazu Tsuya, Tokyo (JP); Kazushige Shinoda, Tokyo (JP)

(73) Assignee: TDK Corporation, Tokyo (JP)

( * ) Notice: Subject to any disclaimer, the term of this patent is extended or adjusted under 35 U.S.C. 154(b) by 657 days.

(21) Appl. No.: 12/289,080

(22) Filed: Oct. 20, 2008

(65) Prior Publication Data

US 2009/0121807 A1 May 14, 2009

(30) Foreign Application Priority Data

Nov. 12, 2007 (JP) ..... 2007-292819

(51) Int. Cl.
*H03H 7/09* (2006.01)
*H01P 1/203* (2006.01)
*H01P 7/08* (2006.01)

(52) U.S. Cl. ..... 333/185; 333/175; 333/219; 333/204

(58) Field of Classification Search ..... 333/165–168, 333/175, 176, 185, 202–205, 219
See application file for complete search history.

(56) References Cited

U.S. PATENT DOCUMENTS

| | | | | |
|---|---|---|---|---|
| 5,892,415 | A | 4/1999 | Okamura | |
| 6,414,568 | B1 * | 7/2002 | Matsumura et al. | 333/185 |
| 6,512,427 | B2 * | 1/2003 | Nakano | 333/132 |
| 7,671,706 | B2 * | 3/2010 | Taniguchi | 333/203 |

FOREIGN PATENT DOCUMENTS

| | | |
|---|---|---|
| JP | A-09-148802 | 6/1997 |
| JP | A-2001-119209 | 4/2001 |
| JP | A-2005-012258 | 1/2005 |
| JP | A-2005-159512 | 6/2005 |

* cited by examiner

*Primary Examiner* — Robert Pascal
*Assistant Examiner* — Gerald Stevens
(74) *Attorney, Agent, or Firm* — Oliff & Berridge, PLC

(57) ABSTRACT

An electronic component includes a layered substrate including a plurality of dielectric layers stacked, and three resonators provided within the layered substrate. One of the three resonators includes resonator-forming conductor layers of a first type and a second type that each have a short-circuited end and an open-circuited end, relative positions of the short-circuited end and the open-circuited end being reversed between the first and second types. The resonator-forming conductor layers of the first type and the second type are arranged to be adjacent to each other in a direction in which the plurality of dielectric layers are stacked.

11 Claims, 15 Drawing Sheets

ELECTRONIC COMPONENT

BACKGROUND OF THE INVENTION

1. Field of the Invention

The present invention relates to an electronic component including a plurality of resonators provided within a layered substrate.

2. Description of the Related Art

There are strong demands for reductions in size and thickness of communication apparatuses for short-range wireless communications, such as communication apparatuses conforming to the Bluetooth standard and communication apparatuses for use on a wireless local area network (LAN). Accordingly, reductions in size and thickness are also demanded of electronic components incorporated in such communication apparatuses. A bandpass filter that filters reception signals is one of electronic components incorporated in the communication apparatuses mentioned above. Reductions in size and thickness are also demanded of the bandpass filter. To meet the demands, a layered filter including a plurality of resonators each formed using at least one conductor layer of a layered substrate has been proposed as a bandpass filter that is operable in the frequency bands used for the above-mentioned communication apparatuses and capable of achieving reductions in size and thickness. Such a layered filter is disclosed in, for example, JP-A-9-148802, JP-A-2001-119209, JP-A-2005-012258 and JP-A-2005-159512. Hereinafter, a conductor layer used for forming a resonator is referred to as a resonator-forming conductor layer.

JP-A-9-148802 discloses a layered bandpass filter including at least two resonators. In this bandpass filter, each of the resonators incorporates two types of internal electrodes that are alternately arranged in the stacking direction and that each have a short-circuited end and an open-circuited end whose relative positions are reversed between the two types.

JP-A-2001-119209 discloses a layered filter module including a plurality of filters, each of the filters including a plurality of inductor-forming conductors. Each of the filters of this module incorporates three resonators formed using the inductor-forming conductors. In this module, the inductor-forming conductors in every adjacent filters do not include portions extending in parallel with each other along the entire length.

FIG. 7 of JP-A-2005-012258 shows a bandpass filter including four resonators. In this bandpass filter, each of the resonators incorporates two types of capacitance-forming electrodes that are alternately arranged in the stacking direction and that each have a short-circuited end and an open-circuited end whose relative positions are reversed between the two types. FIG. 1 of this publication shows a bandpass filter including three resonators Q1, Q2 and Q3. In this bandpass filter, the resonators Q1, Q2 and Q3 incorporate their respective strip lines for inductors. The strip lines of the resonators Q1 and Q2 are combline-coupled to each other, while the strip lines of the resonators Q2 and Q3 are interdigital-coupled to each other.

JP-A-2005-159512 discloses a layered bandpass filter including three resonator electrodes arranged side by side on one dielectric layer. The three resonator electrodes of this bandpass filter are disposed in a combline form or an interdigital form.

Typically, a bandpass filter including a plurality of resonators exhibits a broader passband width and a steeper attenuation pole as the number of the resonators increases.

For a conventional layered bandpass filter including a plurality of resonators, it is required to reduce the distance between every adjacent resonators in order to achieve reductions in size and thickness. If this is done, however, the inductive coupling between every adjacent resonators becomes too strong, so that it becomes difficult to attain desired filter characteristics. Specifically, the passband width of the filter becomes too broad if the inductive coupling between adjacent resonators becomes too strong.

For reducing the inductive coupling between every adjacent resonators in a layered bandpass filter without interfering with reductions in filter size and thickness, a possible approach is to reduce the width of each resonator-forming conductor layer to thereby increase the distance between every adjacent resonators. However, this reduces the Qs of all of the resonators.

To increase the resonator Q, it is effective to increase the surface area of the resonator-forming conductor layer. In view of this, each resonator can be formed using a plurality of resonator-forming conductor layers so as to increase the distance between every adjacent resonators to some extent without reducing the resonator Q. In this case, each resonator can be formed of two types of resonator-forming conductor layers that are alternately arranged in the stacking direction and that each have a short-circuited end and an open-circuited end whose relative positions are reversed between the two types, as proposed in JP-A-9-148802 or JP-A-2005-012258. In this case, the two types of resonator-forming conductor layers alternately arranged in the stacking direction are interdigital-coupled to each other, thereby constituting a resonator including an inductor and a capacitor.

However, if all resonators are each formed of the two types of resonator-forming conductor layers that are interdigital-coupled to each other as described above, the inductive coupling between every adjacent resonators becomes too strong, so that it becomes difficult to attain desired bandpass filter characteristics.

OBJECT AND SUMMARY OF THE INVENTION

It is an object of the present invention to provide an electronic component including a plurality of resonators provided within a layered substrate, the electronic component being capable of preventing the inductive coupling between every adjacent resonators from becoming too strong with miniaturization, while preventing reductions in Qs of all the resonators.

An electronic component of the present invention includes: a layered substrate including a plurality of dielectric layers stacked; and a plurality of resonators provided within the layered substrate such that every adjacent two of the resonators are inductively coupled to each other. In this electronic component, at least one, but not all, of the plurality of resonators includes a resonator-forming conductor layer of a first type and a resonator-forming conductor layer of a second type that each have a short-circuited end and an open-circuited end, relative positions of the short-circuited end and the open-circuited end being reversed between the first and second types. The resonator-forming conductor layers of the first type and the second type are arranged to be adjacent to each other in a direction in which the plurality of dielectric layers are stacked.

According to the electronic component of the present invention, at least one, but not all, of the plurality of resonators includes the resonator-forming conductor layers of the first type and the second type. Consequently, the electronic component of the present invention inevitably includes a portion in which the at least one resonator that includes the resonator-forming conductor layers of the first type and the second type is adjacent to another one that does not include the resonator-forming conductor layers of the first type and the second type.

In the electronic component of the present invention, the plurality of resonators may include a first resonator, a second resonator and a third resonator, and the second resonator may be adjacent to and inductively coupled to each of the first resonator and the third resonator. In this case, of the first, second and third resonators, only the second resonator may include the resonator-forming conductor layers of the first type and the second type, or only the first and third resonators may each include the resonator-forming conductor layers of the first type and the second type.

In the electronic component of the present invention, at least one of the plurality of resonators, other than the at least one that includes the resonator-forming conductor layers of the first type and the second type, may include a through-hole type inductor formed using at least one through hole provided within the layered substrate.

In the electronic component of the present invention, each of the plurality of resonators may be a quarter-wave resonator having a short-circuited end and an open-circuited end.

The electronic component of the present invention may further include an input terminal and an output terminal disposed on a periphery of the layered substrate. The plurality of resonators may be located between the input terminal and the output terminal in terms of circuit configuration, and may implement the function of a bandpass filter. It should be noted that the phrase "in terms of circuit configuration" used herein is intended to mean positioning in a schematic circuit diagram, not in the physical configuration.

According to the electronic component of the present invention, at least one, but not all, of the plurality of resonators includes the resonator-forming conductor layers of the first type and the second type. Consequently, according to the present invention, there inevitably exists a portion in which the at least one resonator that includes the resonator-forming conductor layers of the first type and the second type is adjacent to another one that does not include the resonator-forming conductor layers of the first type and the second type. In this portion, it is possible to make the inductive coupling between the resonators weaker than in a case where two resonators that each include the resonator-forming conductor layers of the first type and the second type are adjacent to each other. Consequently, the present invention makes it possible to prevent the inductive coupling between every adjacent resonators from becoming too strong with miniaturization of the electronic component, while preventing reductions in Qs of all the resonators.

Other and further objects, features and advantages of the invention will appear more fully from the following description.

DETAILED DESCRIPTION OF THE PREFERRED EMBODIMENTS

First Embodiment

Figure 4:
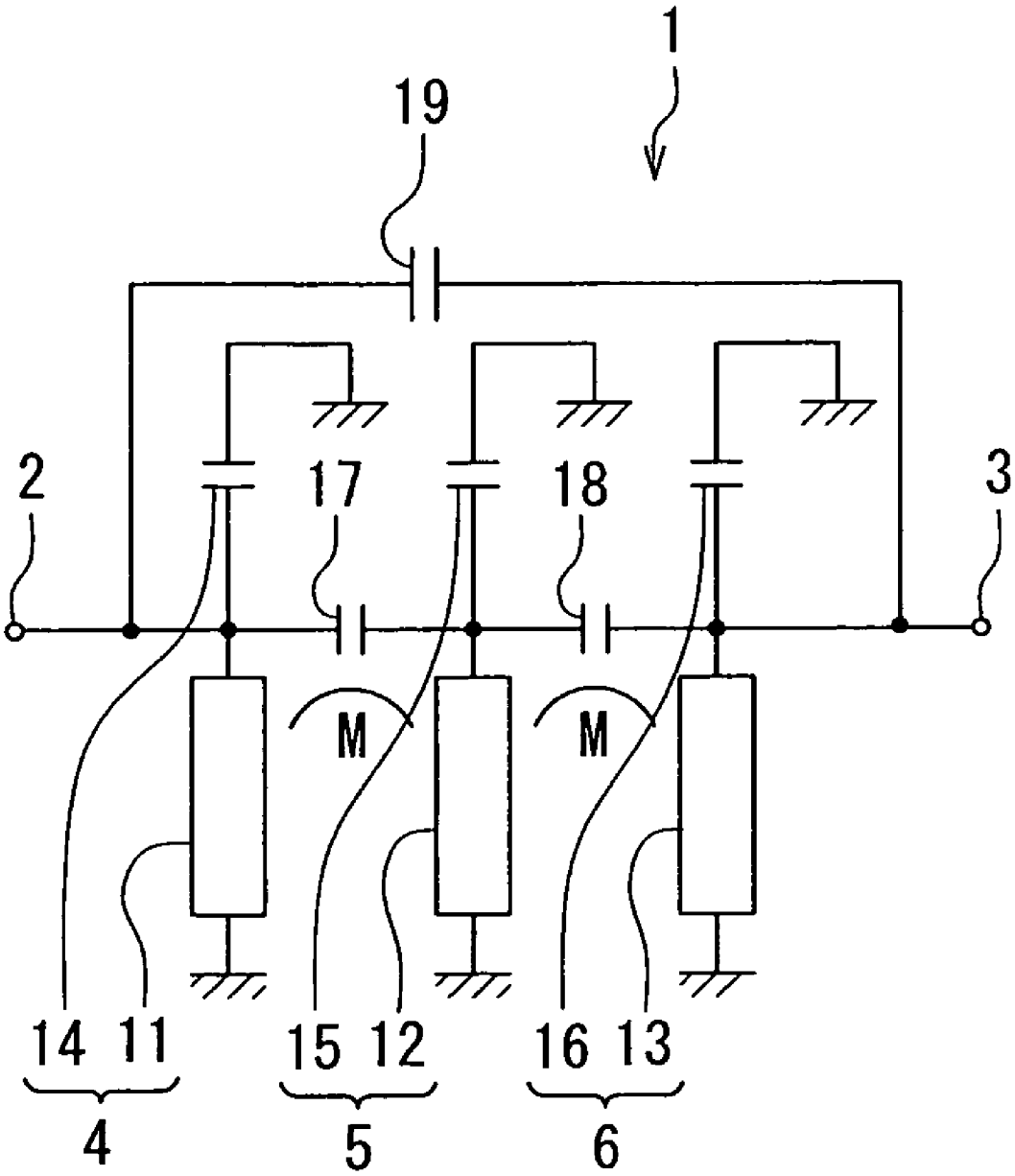
FIG. 4 is a schematic diagram showing the circuit configuration of the electronic component of the first embodiment of the invention.

Preferred embodiments of the present invention will now be described in detail with reference to the drawings. Reference is first made to FIG. 4 to describe the circuit configuration of an electronic component of a first embodiment of the invention. The electronic component 1 of the first embodiment has the function of a bandpass filter. As shown in FIG. 4, the electronic component 1 includes an input terminal 2, an output terminal 3, three resonators 4, 5 and 6, and capacitors 17 to 19.

The resonator 4 includes an inductor 11 and a capacitor 14. The resonator 5 includes an inductor 12 and a capacitor 15. The resonator 6 includes an inductor 13 and a capacitor 16. In terms of circuit configuration, the resonator 5 is located between the resonator 4 and the resonator 6. The resonator 5 is adjacent to and inductively coupled to each of the resonators 4 and 6. The inductor 12 is inductively coupled to each of the inductors 11 and 13. In FIG. 4 the inductive coupling between the inductors 11 and 12 and the inductive coupling between the inductors 12 and 13 are shown with curves M.

One end of the inductor 11 and one end of each of the capacitors 14, 17 and 19 are connected to the input terminal 2. The other end of the inductor 11 and the other end of the capacitor 14 are connected to the ground. One end of the inductor 12 and one end of each of the capacitors 15 and 18 are connected to the other end of the capacitor 17. The other end of the inductor 12 and the other end of the capacitor 15 are connected to the ground. One end of the inductor 13, one end of the capacitor 16, the other end of the capacitor 19 and the output terminal 3 are connected to the other end of the capacitor 18. The other end of the inductor 13 and the other end of the capacitor 16 are connected to the ground. The resonator 5 is inductively coupled to the resonator 4 as mentioned above, and is also capacitively coupled to the resonator 4 through the capacitor 17. The resonator 5 is inductively coupled to the resonator 6 as mentioned above, and is also capacitively coupled to the resonator 6 through the capacitor 18.

The resonators 4, 5 and 6 are located between the input terminal 2 and the output terminal 3 in terms of circuit configuration, and implement the function of a bandpass filter. Each of the resonators 4, 5 and 6 is a quarter-wave resonator having a short-circuited end and an open-circuited end. The resonators 4, 5 and 6 correspond to the first resonator, the second resonator and the third resonator, respectively, of the present invention.

When signals are received at the input terminal 2 of the electronic component 1, among the signals, those of frequencies within a certain frequency band selectively pass through the bandpass filter formed using the resonators 4, 5 and 6, and are outputted from the output terminal 3.

Figure 1:
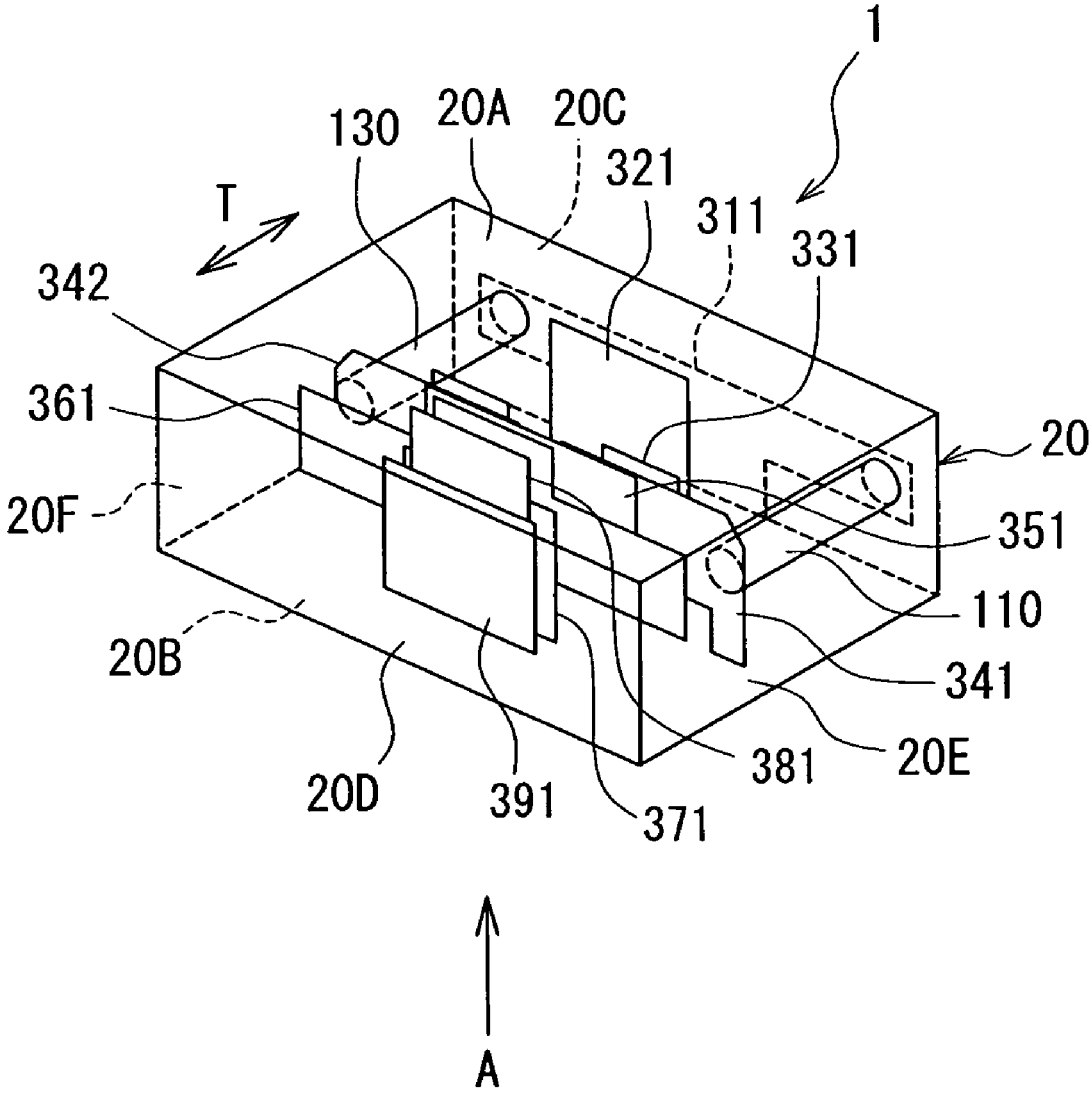
FIG. 1 is a perspective view showing a main part of an electronic component of a first embodiment of the invention.
Figure 2:
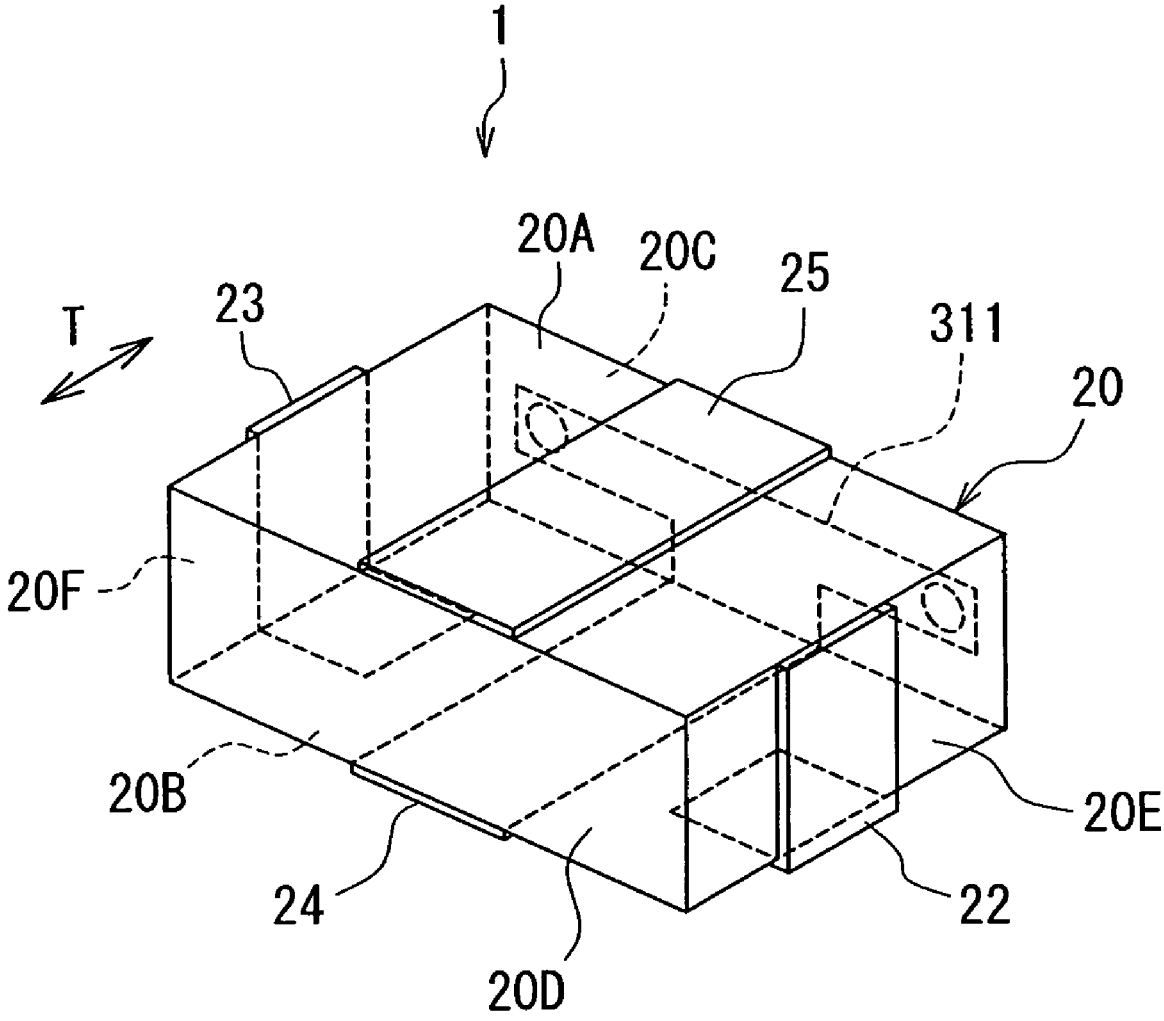
FIG. 2 is a perspective view showing the outer appearance of the electronic component of the first embodiment of the invention.
Figure 3:
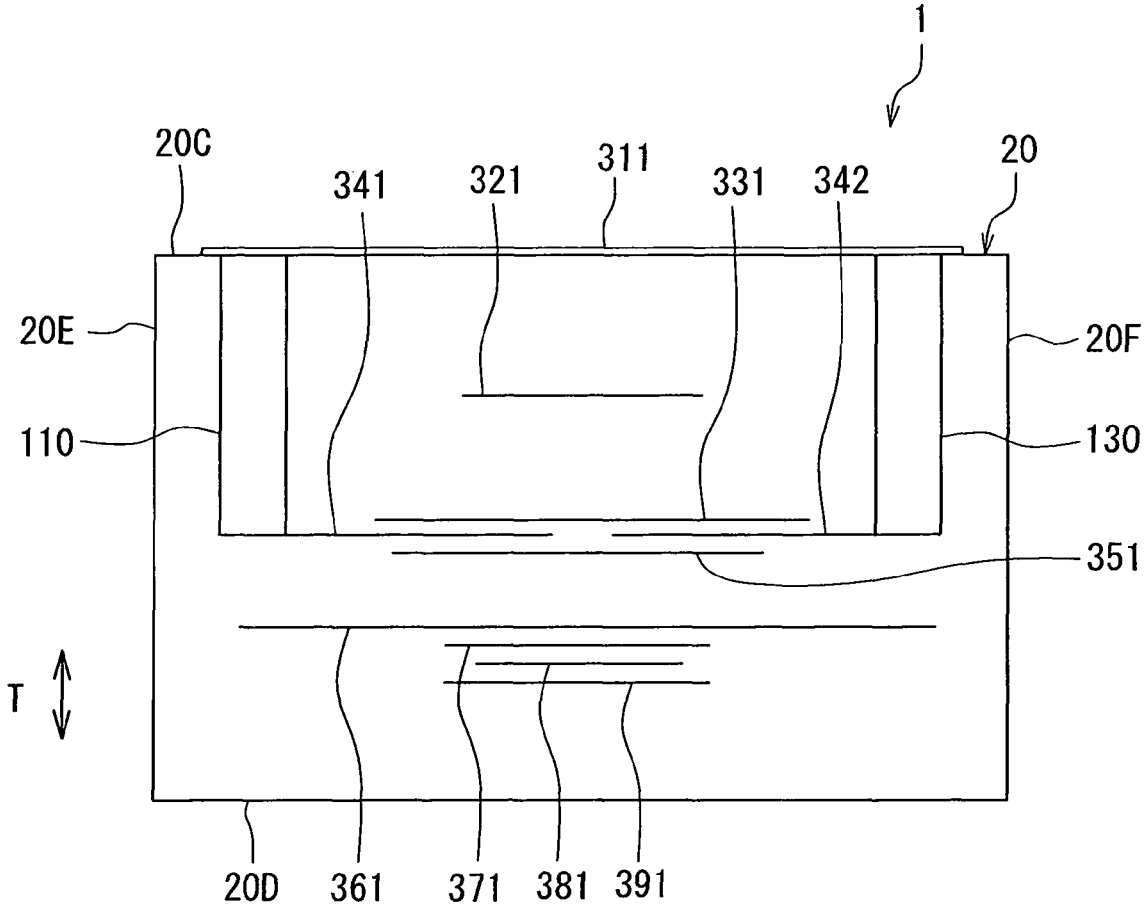
FIG. 3 is an illustrative view showing the main part of the electronic component as viewed from direction A of FIG. 1.

Reference is now made to FIG. 1 to FIG. 3 to outline the structure of the electronic component 1. FIG. 1 is a perspective view showing a main part of the electronic component 1. FIG. 2 is a perspective view showing the outer appearance of the electronic component 1. FIG. 3 is an illustrative view showing the main part of the electronic component 1 as viewed from direction A of FIG. 1.

The electronic component 1 includes a layered substrate 20 for integrating the components of the electronic component 1. As will be described in detail later, the layered substrate 20 includes a plurality of dielectric layers and a plurality of conductor layers that are stacked. Each of the inductors 11 and 13 is a through-hole type inductor formed using one or more through holes provided in the layered substrate 20. The inductor 12 is formed using two or more of the conductor layers located within the layered substrate 20. Each of the capacitors 14 to 19 is formed using two or more of the conductor layers and one or more of the dielectric layers located within the layered substrate 20.

As shown in FIG. 2, the layered substrate 20 is rectangular-solid-shaped and has a top surface 20A, a bottom surface 20B and four side surfaces 20C to 20F, as the periphery. The top surface 20A and the bottom surface 20B are parallel to each other, the side surfaces 20C and 20D are parallel to each other, and the side surfaces 20E and 20F are parallel to each other. The side surfaces 20C to 20F are each perpendicular to the top surface 20A and the bottom surface 20B. On the layered substrate 20, an input terminal 22 is provided to extend from the bottom surface 20B to the end of the side surface 20E, and an output terminal 23 is provided to extend from the bottom surface 20B to the end of the side surface 20F. Grounding terminals 24 and 25 are provided on the bottom surface 20B and the top surface 20A, respectively. The input terminal 22 corresponds to the input terminal 2 of FIG. 4, and the output terminal 23 corresponds to the output terminal 3 of FIG. 4. The grounding terminals 24 and 25 are connected to the ground.

For the layered substrate 20, the direction perpendicular to the side surfaces 20C and 20D is the direction in which the plurality of dielectric layers are stacked. In FIG. 1 to FIG. 3 the arrow T indicates the direction in which the plurality of dielectric layers are stacked.

Figure 5A:
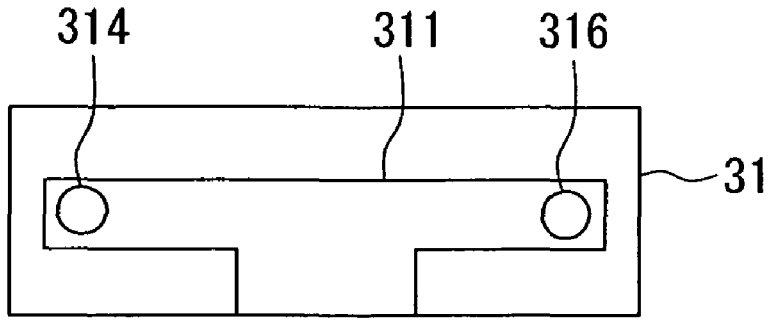
FIG. 5A to FIG. 5C are illustrative views respectively showing the top surfaces of first to third dielectric layers of a layered substrate of the first embodiment of the invention.
Figure 5B:
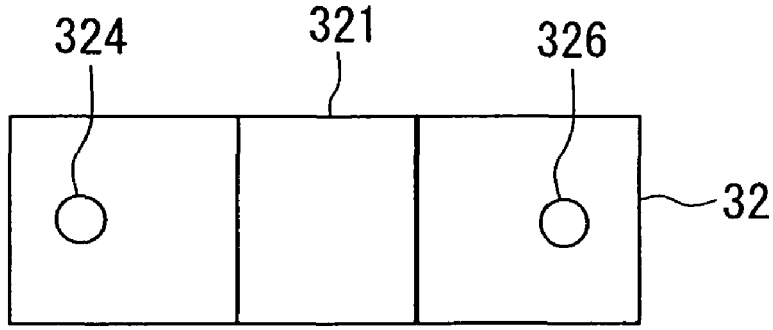
Figure 5C:
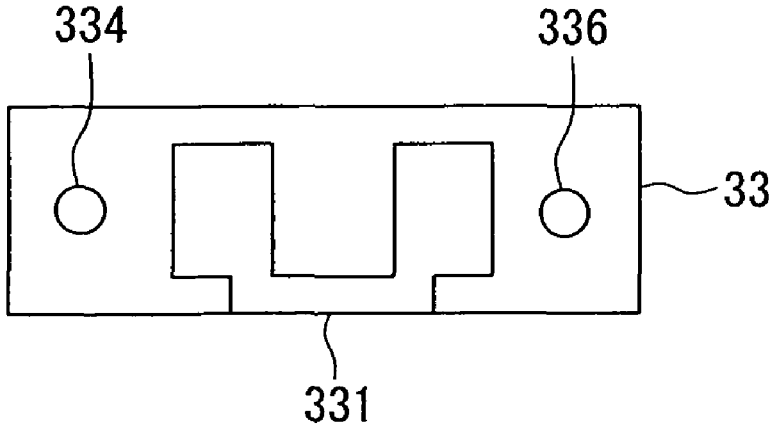
Figure 6A:
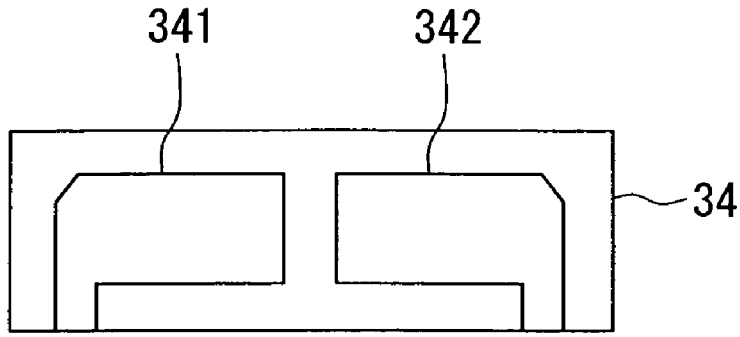
FIG. 6A to FIG. 6C are illustrative views respectively showing the top surfaces of fourth to sixth dielectric layers of the layered substrate of the first embodiment of the invention.
Figure 6B:
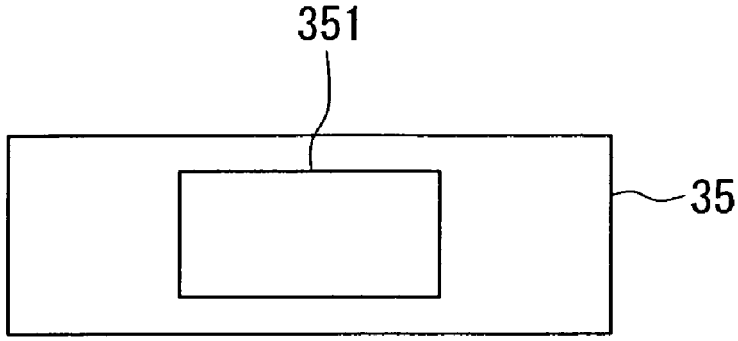
Figure 6C:
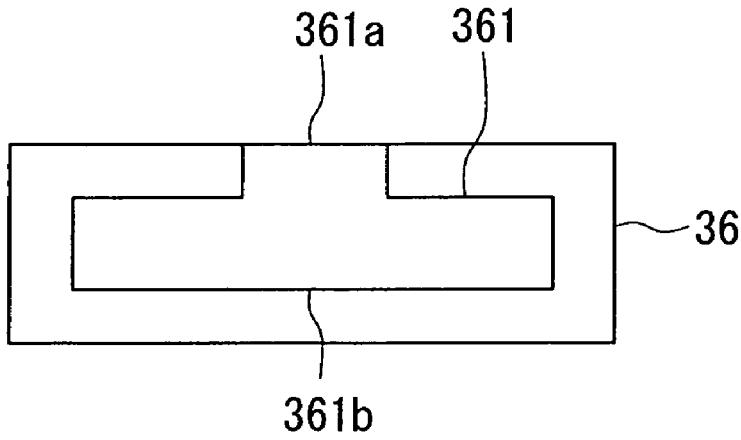
Figure 7A:
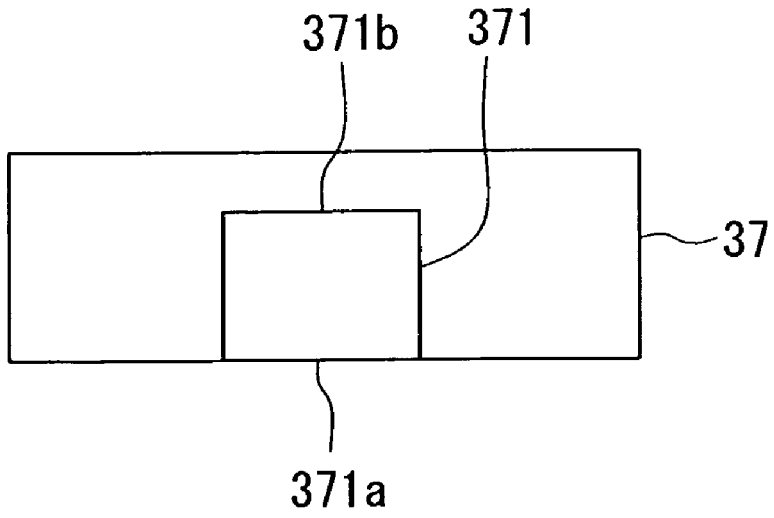
FIG. 7A to FIG. 7C are illustrative views respectively showing the top surfaces of seventh to ninth dielectric layers of the layered substrate of the first embodiment of the invention.
Figure 7B:
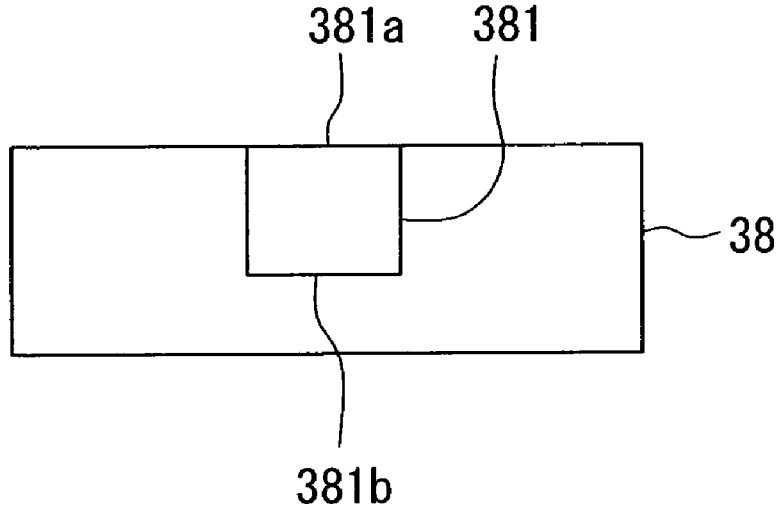
Figure 7C:
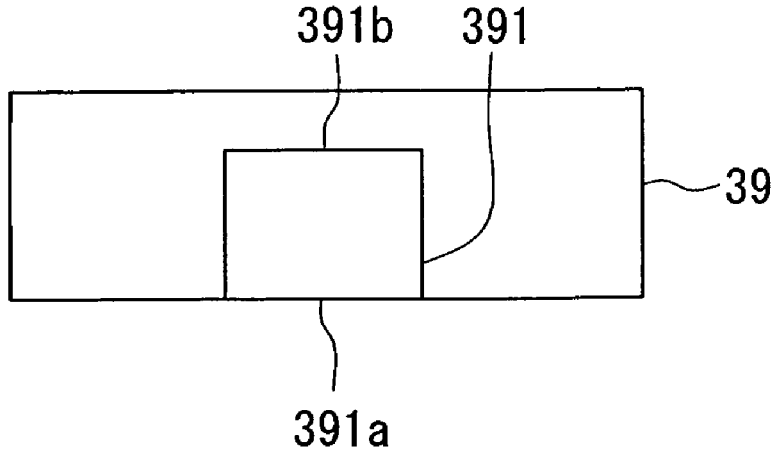

Reference is now made to FIG. 5A to FIG. 7C to describe the dielectric layers and the conductor layers of the layered substrate 20 in detail. FIG. 5A to FIG. 5C respectively show the top surfaces of the first to third dielectric layers from the top. FIG. 6A to FIG. 6C respectively show the top surfaces of the fourth to sixth dielectric layers from the top. FIG. 7A to FIG. 7C respectively show the top surfaces of the seventh to ninth dielectric layers from the top.

A grounding conductor layer 311 is formed on the top surface of the first dielectric layer 31 of FIG. 5A. The conductor layer 311 is connected to the grounding terminal 24. The dielectric layer 31 has two through holes 314 and 316 connected to the conductor layer 311.

A grounding conductor layer 321 is formed on the top surface of the second dielectric layer 32 of FIG. 5B. The conductor layer 321 is connected to the grounding terminals 24 and 25. The dielectric layer 32 has through holes 324 and 326 that are respectively connected to the through holes 314 and 316.

A capacitor-forming conductor layer 331 is formed on the top surface of the third dielectric layer 33 of FIG. 5C. The conductor layer 331 is connected to the grounding terminal 24. The dielectric layer 33 has through holes 334 and 336 that are respectively connected to the through holes 324 and 326.

Capacitor-forming conductor layers 341 and 342 are formed on the top surface of the fourth dielectric layer 34 of FIG. 6A. The conductor layer 341 is connected to the input terminal 22, and the conductor layer 342 is connected to the output terminal 23. The through hole 334 is connected to the conductor layer 341, and the through hole 336 is connected to the conductor layer 342.

A capacitor-forming conductor layer 351 is formed on the top surface of the fifth dielectric layer 35 of FIG. 6B.

A resonator-forming conductor layer 361 is formed on the top surface of the sixth dielectric layer 36 of FIG. 6C. The conductor layer 361 has a short-circuited end 361*a*, and an open-circuited end 361*b* opposite thereto. The short-circuited end 361*a* is connected to the grounding terminal 25.

A resonator-forming conductor layer 371 is formed on the top surface of the seventh dielectric layer 37 of FIG. 7A. The conductor layer 371 has a short-circuited end 371*a*, and an open-circuited end 371*b* opposite thereto. The short-circuited end 371*a* is connected to the grounding terminal 24.

A resonator-forming conductor layer 381 is formed on the top surface of the eighth dielectric layer 38 of FIG. 7B. The conductor layer 381 has a short-circuited end 381*a*, and an open-circuited end 381*b* opposite thereto. The short-circuited end 381*a* is connected to the grounding terminal 25.

A resonator-forming conductor layer 391 is formed on the top surface of the ninth dielectric layer 39 of FIG. 7C. The conductor layer 391 has a short-circuited end 391*a*, and an open-circuited end 391*b* opposite thereto. The short-circuited end 391*a* is connected to the grounding terminal 24. No conductor layer is formed on the bottom surface of the dielectric layer 39.

The through holes 314, 324 and 334 are connected in series to each other to form a through hole line 110 shown in FIG. 1 and FIG. 3. Similarly, the through holes 316, 326 and 336 are connected in series to each other to form a through hole line 130 shown in FIG. 1 and FIG. 3. The through hole line 110 constitutes the inductor 11 of the resonator 4, and the through hole line 130 constitutes the inductor 13 of the resonator 6.

The conductor layers 361, 371, 381 and 391 each have the short-circuited end and the open-circuited end, and are arranged in the direction in which the plurality of dielectric layers are stacked, such that the relative positions of the short-circuited end and the open-circuited end are alternately reversed. The conductor layers 361 and 381 are the same in relative positions of the short-circuited end and the open-circuited end. Each of the conductor layers 361 and 381 will be hereinafter called a resonator-forming conductor layer of a first type. The conductor layers 371 and 391 are the same in relative positions of the short-circuited end and the open-circuited end. Each of the conductor layers 371 and 391 will be hereinafter called a resonator-forming conductor layer of a second type. The relative positions of the short-circuited end and the open-circuited end are reversed between the resonator-forming conductor layers of the first type 361, 381 and the second type 371, 391. Thus, the resonator-forming conductor layers of the first type and the second type, being reversed in relative positions of the short-circuited end and the open-circuited end, are alternately arranged to be adjacent to each other in the direction in which the plurality of dielectric layers are stacked.

The resonator-forming conductor layers of the first type 361, 381 and the second type 371, 391 are interdigital-coupled to each other to thereby constitute the inductor 12 of the resonator 5. According to the present embodiment, of the three resonators 4, 5 and 6, only the resonator 5 includes the resonator-forming conductor layers of the first type and the second type that are interdigital-coupled to each other.

The conductor layers 331 and 341 and the dielectric layer 33 constitute the capacitor 14 of the resonator 4. The conductor layers 331 and 342 and the dielectric layer 33 constitute the capacitor 16 of the resonator 6. The conductor layers 361, 371, 381 and 391 and the dielectric layers 36, 37 and 38 constitute the capacitor 15 of the resonator 5.

The conductor layers 341 and 361 and the dielectric layers 34 and 35 constitute the capacitor 17 of FIG. 4. The conductor layers 342 and 361 and the dielectric layers 34 and 35 constitute the capacitor 18 of FIG. 4. The conductor layers 341, 342 and 351 and the dielectric layer 34 constitute the capacitor 19 of FIG. 4.

The first to ninth dielectric layers 31 to 39 and the conductor layers described above are stacked to form the layered substrate 20 shown in FIG. 1 to FIG. 3. The terminals 22 to 25 shown in FIG. 2 are formed on the periphery of the layered substrate 20.

In the present embodiment, a variety of types of substrates are employable as the layered substrate 20, such as one in which the dielectric layers are formed of a resin, ceramic, or a resin-ceramic composite material. However, a low-temperature co-fired ceramic multilayer substrate, which is excellent in high frequency response, is particularly preferable as the layered substrate 20.

In the present embodiment, only the resonator 5 of the three resonators 4, 5 and 6 includes the inductor 12 formed of the resonator-forming conductor layers of the first type and the second type that are interdigital-coupled to each other. According to the present embodiment, it is possible to increase the Q of the inductor 12 and consequently increase the Q of the resonator 5, compared with a case in which the inductor of the resonator 5 is formed only of a single resonator-forming conductor layer.

Typically, in an electronic component that includes three resonators and performs the function of a bandpass filter, the resonator located in the middle tends to be lower in Q than the other two resonators. This is because the middle resonator tends to cause an electric field loss between itself and a conductor layer connected to the ground, compared with the other two resonators. According to the present embodiment, of the three resonators 4, 5 and 6, the resonator 5 located in the middle includes the resonator-forming conductor layers of the first type and the second type that are interdigital-coupled to each other. This serves to prevent the resonator 5, which particularly tends to suffer a reduction in Q, from suffering the reduction in Q.

In the present embodiment, the resonators 4 and 6, which are other than the resonator 5 that includes the resonator-forming conductor layers of the first type and the second type as described above, respectively include the through-hole type inductors 11 and 13 formed using the through holes provided within the layered substrate 20. Compared with an inductor formed only of a single resonator-forming conductor layer, the through-hole type inductor has a larger surface area and consequently has a higher Q. Accordingly, the present embodiment provides higher Qs for the inductors 11 and 13, and consequently provides higher Qs for the resonators 4 and 6, compared with a case in which the inductors of the resonators 4 and 6 are each formed only of a single resonator-forming conductor layer.

If all of the resonators 4, 5 and 6 each include the resonator-forming conductor layers of the first type and the second type that are interdigital-coupled to each other, the inductive coupling between the resonators 4 and 5 and the inductive coupling between the resonators 5 and 6 become too strong. In contrast, according to the present embodiment, only the resonator 5 of the three resonators 4, 5 and 6 includes the resonator-forming conductor layers of the first type and the second type that are interdigital-coupled to each other, and the other two resonators 4 and 6, which are inductively coupled to the resonator 5, do not. Consequently, according to the present embodiment, the inductive coupling between the resonators 4 and 5 and the inductive coupling between the resonators 5 and 6 are each weaker than in the case where all of the resonators 4, 5 and 6 each include the resonator-forming conductor layers of the first type and the second type that are interdigital-coupled to each other.

According to the present embodiment, in particular, the direction of travel of electromagnetic waves in the inductors 11 and 13 of the resonators 4 and 6 and the direction of travel of electromagnetic waves in the inductor 12 of the resonator 5 are orthogonal to each other. This serves to further weaken the inductive coupling between the resonators 4 and 5 and the inductive coupling between the resonators 5 and 6.

Consequently, the present embodiment makes it possible to prevent the inductive coupling between every adjacent resonators from becoming too strong with miniaturization of the electronic component, while preventing reductions in Qs of all the resonators. Furthermore, the present embodiment facilitates reductions in size and thickness of the electronic component 1, because the embodiment allows a reduction in magnitude of the inductive coupling between every adjacent resonators even in the case where the distance between every adjacent resonators must be reduced with reductions in size and thickness of the electronic component 1.

The electronic component 1 of the present embodiment is designed to function as a bandpass filter having a passband of, for example, approximately 2.4 to 2.5 GHz. The 2.4 to 2.5 GHz band corresponds to the passband of a bandpass filter for use in a communication apparatus conforming to the Bluetooth standard and a communication apparatus for use on a wireless LAN.

Figure 8:
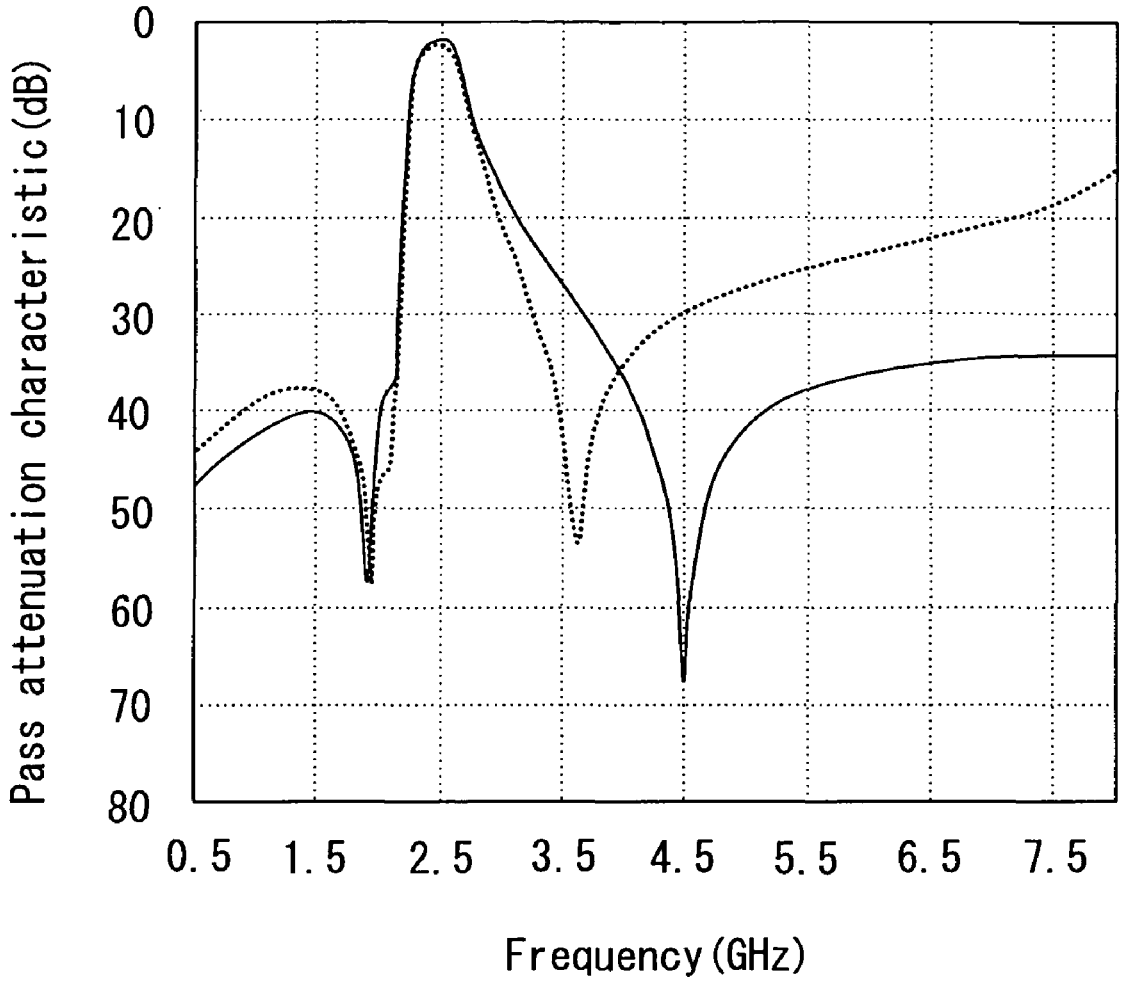
FIG. 8 is a plot showing the pass attenuation characteristic of the electronic component of the first embodiment of the invention and that of an electronic component of a comparative example.
Figure 9:
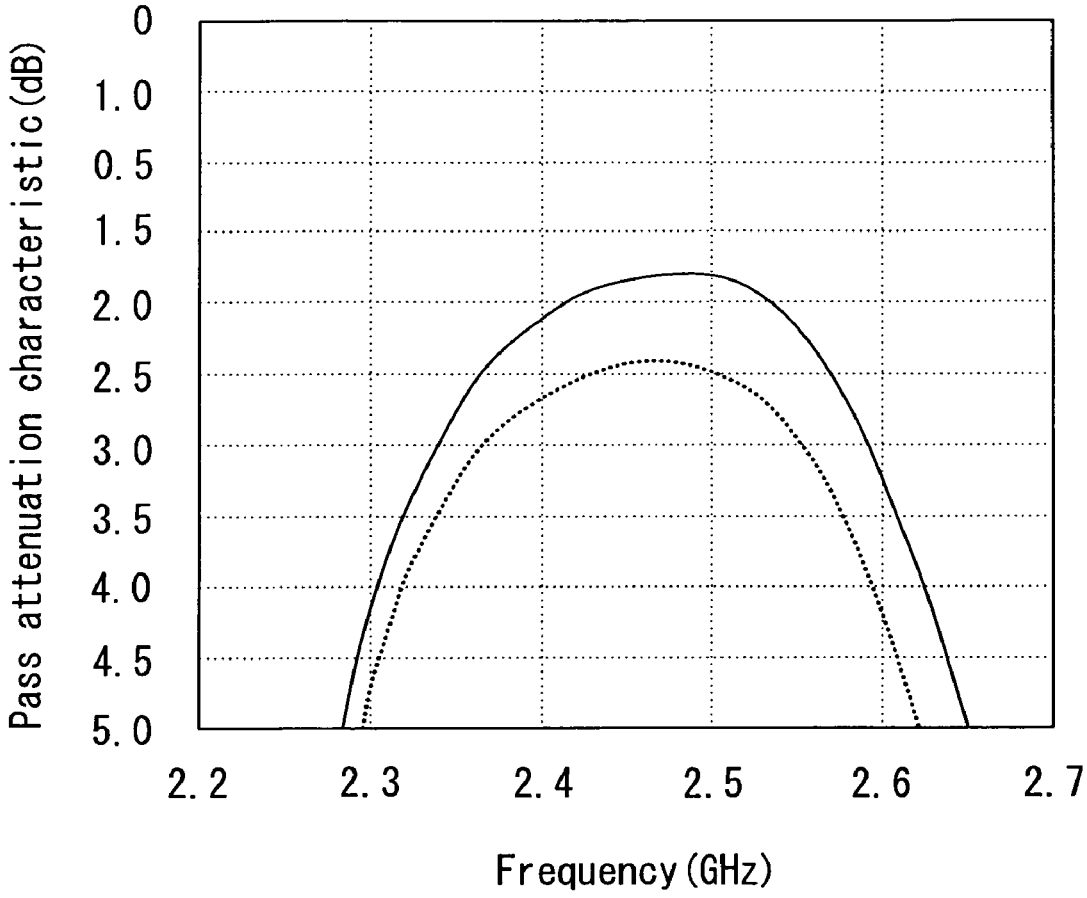
FIG. 9 is a plot showing an enlarged view of a portion of FIG. 8.

Reference is now made to FIG. 8 and FIG. 9 to describe an example of pass attenuation characteristics determined by simulation on the electronic component 1 of the present embodiment and an electronic component of a comparative example. For this simulation, the electronic component 1 of the present embodiment and the electronic component of the comparative example are each designed to function as a bandpass filter having a passband of approximately 2.4 to 2.5 GHz.

The electronic component of the comparative example has the same circuit configuration as that of the electronic component 1 of the present embodiment. In the electronic component of the comparative example, the inductor of each resonator includes three resonator-forming conductor layers stacked. The three resonator-forming conductor layers are connected to each other at portions near their respective one ends. The other end of each of the three layers is connected to the ground.

FIG. 8 shows the pass attenuation characteristic of the electronic component 1 of the present embodiment and that of the electronic component of the comparative example. FIG. 9 shows an enlarged view of a portion of FIG. 8. In each of FIG. 8 and FIG. 9 the solid curve shows the characteristic of the electronic component 1 of the present embodiment while the dotted curve shows the characteristic of the electronic component of the comparative example. As can be seen from FIG. 9, the electronic component 1 of the present embodiment has a smaller attenuation in the passband (2.4 to 2.5 GHz) than that of the electronic component of the comparative example. This is presumably because the inductors 11, 12 and 13 of the resonators 4, 5 and 6 of the present embodiment have higher Qs.

Second Embodiment

An electronic component of a second embodiment of the invention will now be described. The electronic component 1 of the second embodiment has the same circuit configuration as that of the first embodiment shown in FIG. 4.

Figure 10:
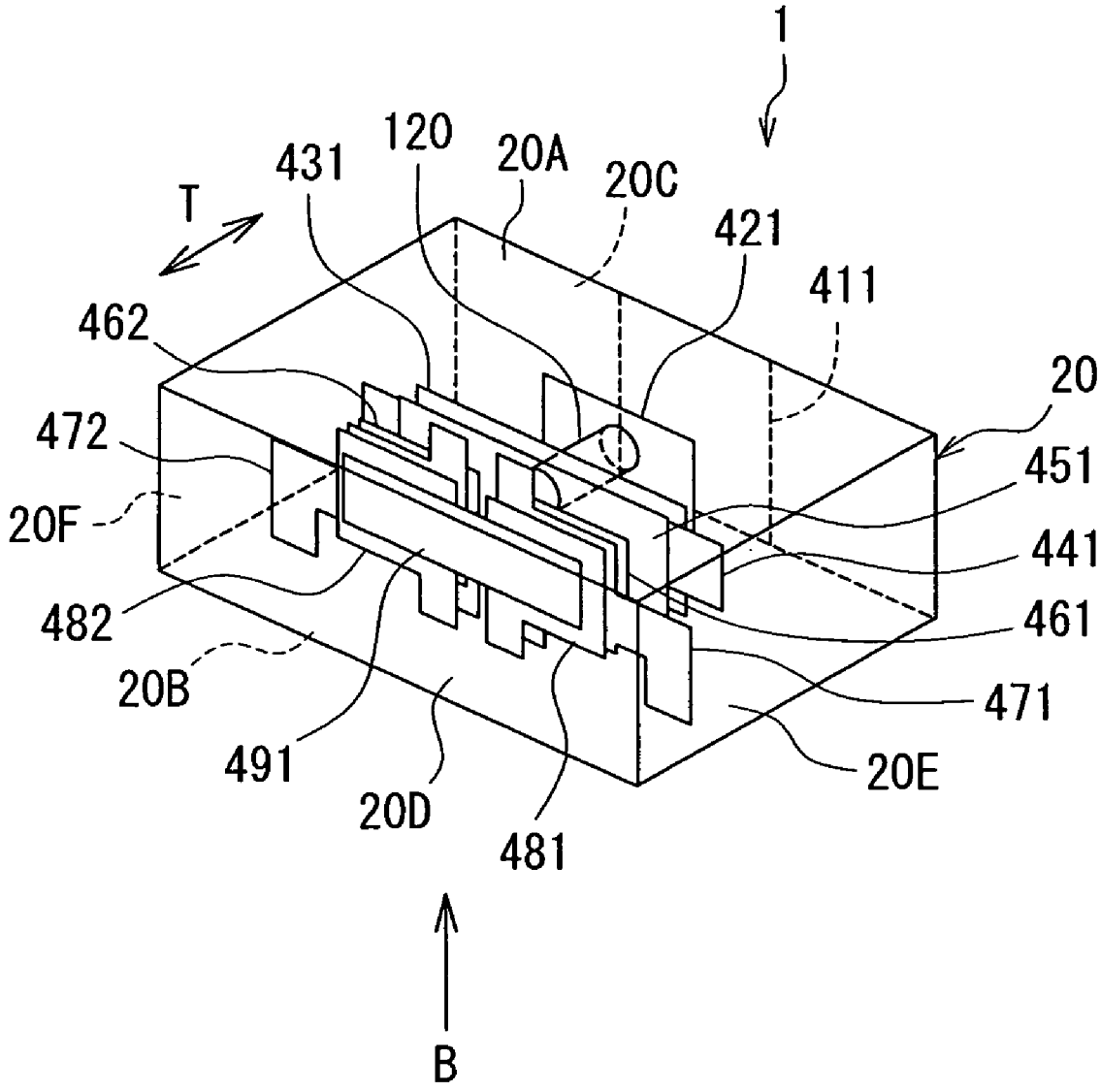
FIG. 10 is a perspective view showing a main part of an electronic component of a second embodiment of the invention.
Figure 11:
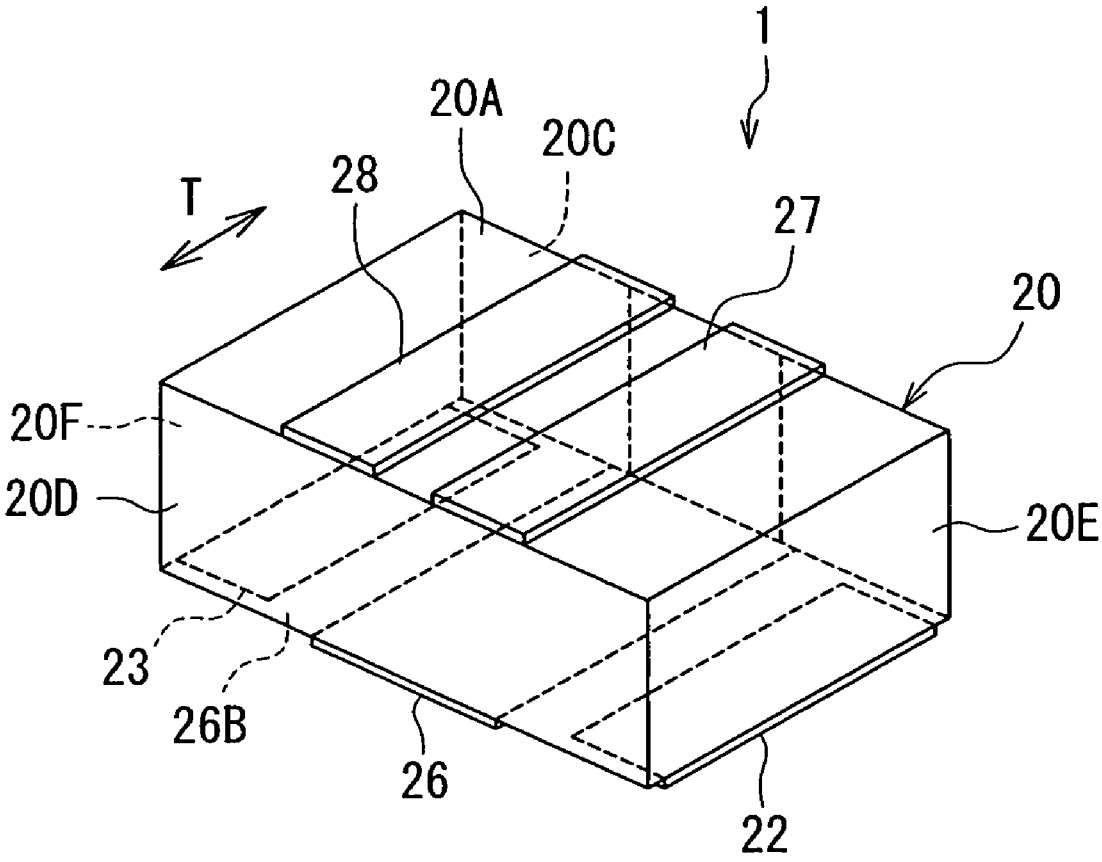
FIG. 11 is a perspective view showing the outer appearance of the electronic component of the second embodiment of the invention.
Figure 12:
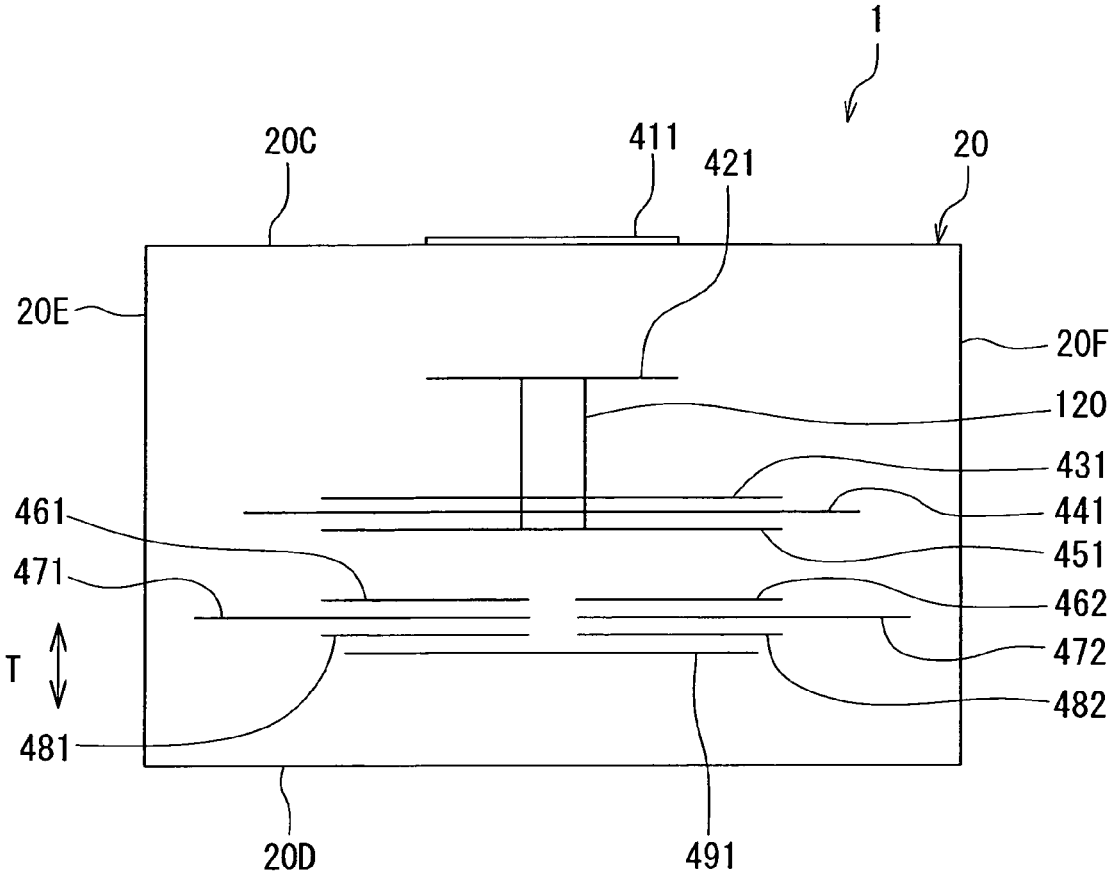
FIG. 12 is an illustrative view showing the main part of the electronic component as viewed from direction B of FIG. 10.

FIG. 10 is a perspective view showing a main part of the electronic component 1 of the second embodiment. FIG. 11 is a perspective view showing the outer appearance of the electronic component 1 of the second embodiment. FIG. 12 is an illustrative view showing the main part of the electronic component 1 as viewed from direction B of FIG. 10.

The electronic component 1 includes a layered substrate 20 for integrating the components of the electronic component 1. As will be described in detail later, the layered substrate 20 includes a plurality of dielectric layers and a plurality of conductor layers that are stacked. Each of the inductors 11 and 13 is formed using two or more of the conductor layers located within the layered substrate 20. The inductor 12 is a through-hole type inductor formed using one or more through holes provided in the layered substrate 20. Each of the capacitors 14 to 19 is formed using two or more of the conductor layers and one or more of the dielectric layers located within the layered substrate 20.

As shown in FIG. 11, the layered substrate 20 is rectangular-solid-shaped and has a top surface 20A, a bottom surface 20B and four side surfaces 20C to 20F, as the periphery. The top surface 20A and the bottom surface 20B are parallel to each other, the side surfaces 20C and 20D are parallel to each other, and the side surfaces 20E and 20F are parallel to each other. The side surfaces 20C to 20F are each perpendicular to the top surface 20A and the bottom surface 20B. An input terminal 22, an output terminal 23 and a grounding terminal 26 are provided on the bottom surface 20B of the layered substrate 20. On the bottom surface 20B the input terminal 22 is located closer to the side surface 20E, the output terminal 23 is located closer to the side surface 20F, and the grounding terminal 26 is located between the input terminal 22 and the output terminal 23. Grounding terminals 27 and 28 are provided on the top surface 20A. The input terminal 22 corresponds to the input terminal 2 of FIG. 4, and the output terminal 23 corresponds to the output terminal 3 of FIG. 4. The grounding terminals 26, 27 and 28 are connected to the ground.

For the layered substrate 20, the direction perpendicular to the side surfaces 20C and 20D is the direction in which the plurality of dielectric layers are stacked. In FIG. 10 to FIG. 12 the arrow T indicates the direction in which the plurality of dielectric layers are stacked.

Figure 13A:
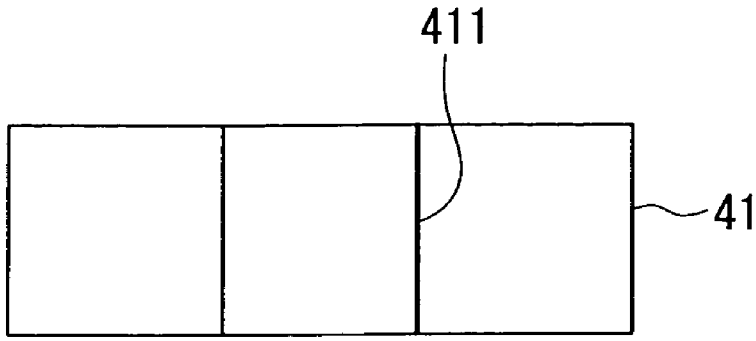
FIG. 13A to FIG. 13C are illustrative views respectively showing the top surfaces of first to third dielectric layers of a layered substrate of the second embodiment of the invention.
Figure 13B:
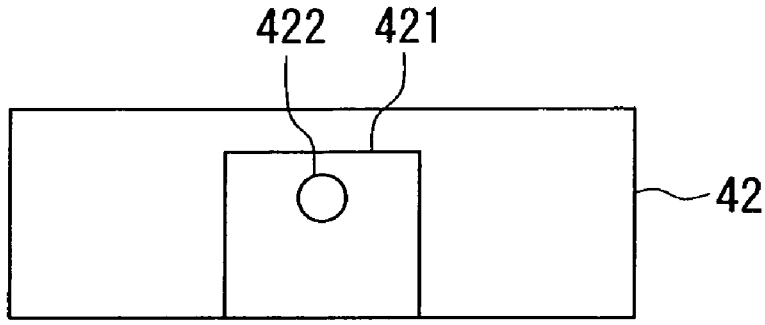
Figure 13C:
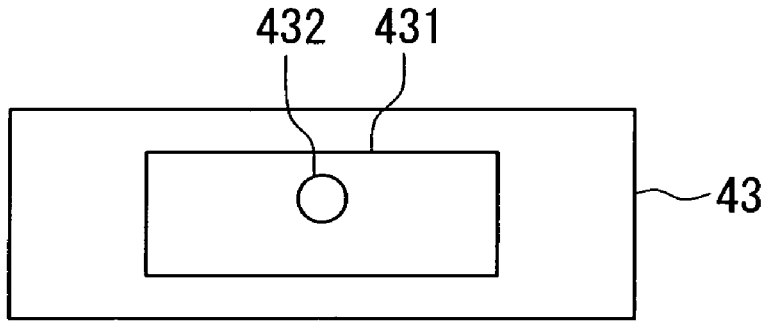
Figure 14A:
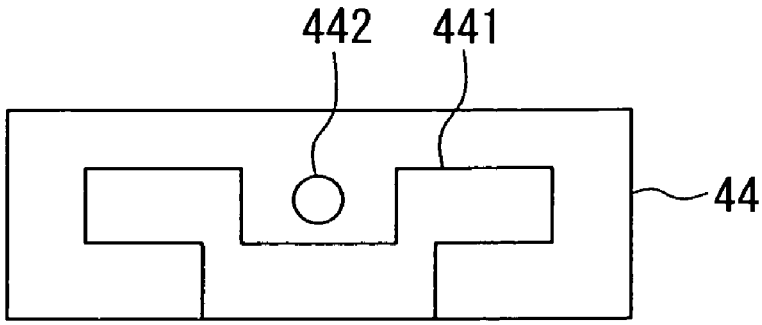
FIG. 14A to FIG. 14C are illustrative views respectively showing the top surfaces of fourth to sixth dielectric layers of the layered substrate of the second embodiment of the invention.
Figure 14B:
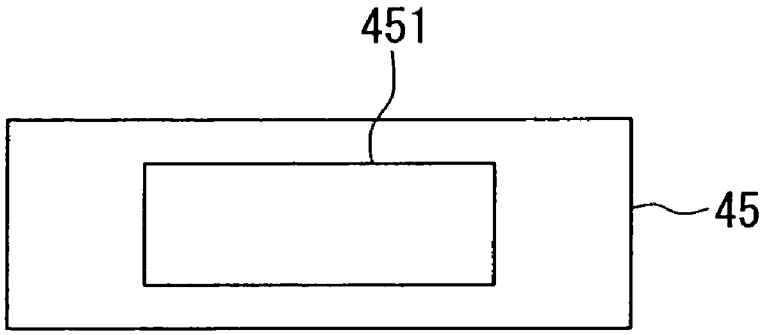
Figure 14C:
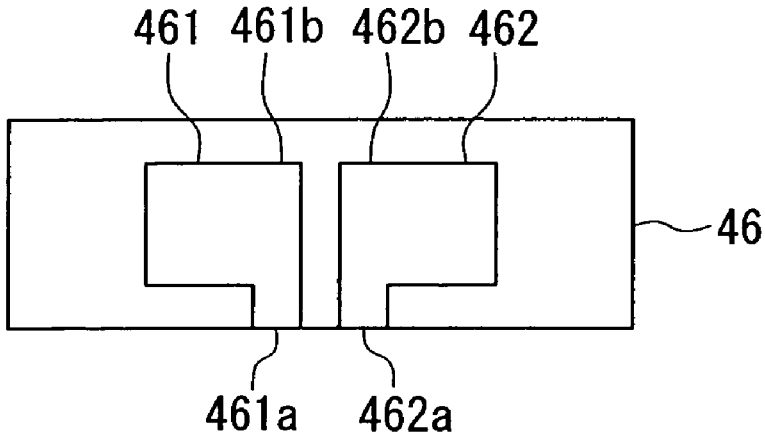
Figure 15A:
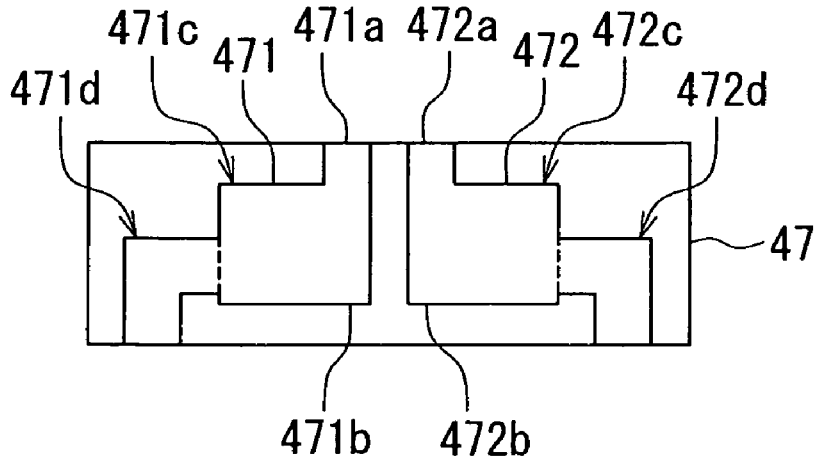
FIG. 15A to FIG. 15C are illustrative views respectively showing the top surfaces of seventh to ninth dielectric layers of the layered substrate of the second embodiment of the invention.
Figure 15B:
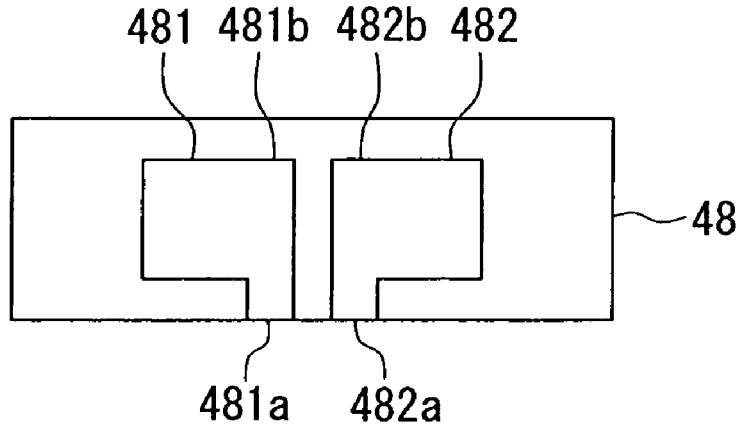
Figure 15C:
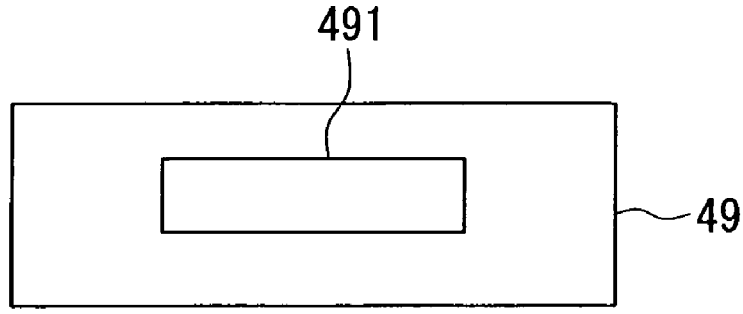

Reference is now made to FIG. 13A to FIG. 15C to describe the dielectric layers and the conductor layers of the layered substrate 20 in detail. FIG. 13A to FIG. 13C respectively show the top surfaces of the first to third dielectric layers from the top. FIG. 14A to FIG. 14C respectively show the top surfaces of the fourth to sixth dielectric layers from the top. FIG. 15A to FIG. 15C respectively show the top surfaces of the seventh to ninth dielectric layers from the top.

A grounding conductor layer 411 is formed on the top surface of the first dielectric layer 41 of FIG. 13A. The conductor layer 411 is connected to the grounding terminals 26, 27 and 28.

A grounding conductor layer 421 is formed on the top surface of the second dielectric layer 42 of FIG. 13B. The conductor layer 421 is connected to the grounding terminal 26. The dielectric layer 42 has a through hole 422 connected to the conductor layer 421.

A capacitor-forming conductor layer 431 is formed on the top surface of the third dielectric layer 43 of FIG. 13C. The dielectric layer 43 has a through hole 432 connected to the through hole 422.

A capacitor-forming conductor layer 441 is formed on the top surface of the fourth dielectric layer 44 of FIG. 14A. The conductor layer 441 is connected to the grounding terminal 26. The dielectric layer 44 has a through hole 442 connected to the through hole 432.

A capacitor-forming conductor layer 451 is formed on the top surface of the fifth dielectric layer 45 of FIG. 14B. The through hole 442 is connected to the conductor layer 451.

Resonator-forming conductor layers 461 and 462 are formed on the top surface of the sixth dielectric layer 46 of FIG. 14C. The conductor layer 461 has a short-circuited end 461*a*, and an open-circuited end 461*b* opposite thereto. The short-circuited end 461*a* is connected to the grounding terminal 26. The conductor layer 462 has a short-circuited end 462*a*, and an open-circuited end 462*b* opposite thereto. The short-circuited end 462*a* is connected to the grounding terminal 26.

Resonator-forming conductor layers 471 and 472 are formed on the top surface of the seventh dielectric layer 47 of FIG. 15A. The conductor layer 471 includes a main body portion 471*c* and a connecting portion 471*d*. The boundary between the main body portion 471*c* and the connecting portion 471*d* is shown with a dotted line in FIG. 15A. The main body portion 471*c* includes a short-circuited end 471*a*, and an open-circuited end 471*b* opposite thereto. The short-circuited end 471*a* is connected to the grounding terminal 27. One end of the connecting portion 471*d* is connected to a portion of the main body portion 471*c* near the open-circuited end 471*b*. The other end of the connecting portion 471*d* is connected to the input terminal 22.

The conductor layer 472 includes a main body portion 472*c* and a connecting portion 472*d*. The boundary between the main body portion 472*c* and the connecting portion 472*d* is shown with a dotted line in FIG. 15A. The main body portion 472*c* includes a short-circuited end 472*a*, and an open-circuited end 472*b* opposite thereto. The short-circuited end 472*a* is connected to the grounding terminal 28. One end of the connecting portion 472*d* is connected to a portion of the main body portion 472*c* near the open-circuited end 472*b*. The other end of the connecting portion 472*d* is connected to the output terminal 23.

Resonator-forming conductor layers 481 and 482 are formed on the top surface of the eighth dielectric layer 48 of FIG. 15B. The conductor layer 481 has a short-circuited end 481*a*, and an open-circuited end 481*b* opposite thereto. The short-circuited end 481*a* is connected to the grounding terminal 26. The conductor layer 482 has a short-circuited end 482*a*, and an open-circuited end 482*b* opposite thereto. The short-circuited end 482*a* is connected to the grounding terminal 26.

A capacitor-forming conductor layer 491 is formed on the top surface of the ninth dielectric layer 49 of FIG. 15C.

The through holes 422, 432 and 442 are connected in series to each other to form a through hole line 120 shown in FIG. 10 and FIG. 12. The through hole line 120 constitutes the inductor 12 of the resonator 5.

The conductor layers 461, 471 and 481 each have the short-circuited end and the open-circuited end, and are arranged in the direction in which the plurality of dielectric layers are stacked, such that the relative positions of the short-circuited end and the open-circuited end are alternately reversed. The conductor layers 461 and 481 are the same in relative positions of the short-circuited end and the open-circuited end. Each of these conductor layers 461 and 481 will be hereinafter called a resonator-forming conductor layer of a first type. The conductor layer 471 will be hereinafter called a resonator-forming conductor layer of a second type. The relative positions of the short-circuited end and the open-circuited end are reversed between the resonator-forming conductor layers of the first type 461, 481 and the second type 471. Thus, the resonator-forming conductor layers of the first type and the second type, being reversed in relative positions of the short-circuited end and the open-circuited end, are alternately arranged to be adjacent to each other in the direction in which the plurality of dielectric layers are stacked. The resonator-forming conductor layers of the first type 461, 481 and the second type 471 are interdigital-coupled to each other to thereby constitute the inductor 11 of the resonator 4.

The conductor layers 462, 472 and 482 each have the short-circuited end and the open-circuited end, and are arranged in the direction in which the plurality of dielectric layers are stacked, such that the relative positions of the short-circuited end and the open-circuited end are alternately reversed. The conductor layers 462 and 482 are the same in relative positions of the short-circuited end and the open-circuited end. Each of these conductor layers 462 and 482 will be hereinafter called a resonator-forming conductor layer of a first type. The conductor layer 472 will be hereinafter called a resonator-forming conductor layer of a second type. The relative positions of the short-circuited end and the open-circuited end are reversed between the resonator-forming conductor layers of the first type 462, 482 and the second type 472. Thus, the resonator-forming conductor layers of the first type and the second type, being reversed in relative positions of the short-circuited end and the open-circuited end, are alternately arranged to be adjacent to each other in the direction in which the plurality of dielectric layers are stacked. The resonator-forming conductor layers of the first type 462, 482 and the second type 472 are interdigital-coupled to each other to thereby constitute the inductor 13 of the resonator 6.

According to the second embodiment, of the three resonators 4, 5 and 6, only the resonators 4 and 6 each include the resonator-forming conductor layers of the first type and the second type that are interdigital-coupled to each other.

The conductor layers 461, 471 and 481 and the dielectric layers 46 and 47 constitute the capacitor 14 of the resonator 4. The conductor layers 462, 472 and 482 and the dielectric layers 46 and 47 constitute the capacitor 16 of the resonator 6. The conductor layers 431, 441 and 451 and the dielectric layers 43 and 44 constitute the capacitor 15 of the resonator 5.

The conductor layers 451 and 461 and the dielectric layer 46 constitute the capacitor 17 of FIG. 4. The conductor layers 451 and 462 and the dielectric layer 46 constitute the capacitor 18 of FIG. 4. The conductor layers 481, 482 and 491 and the dielectric layer 48 constitute the capacitor 19 of FIG. 4.

The first to ninth dielectric layers 41 to 49 and the conductor layers described above are stacked to form the layered substrate 20 shown in FIG. 10 to FIG. 12. The terminals 22, 23 and 26 to 28 shown in FIG. 11 are formed on the periphery of the layered substrate 20.

In the second embodiment, as in the first embodiment, a variety of types of substrates are employable as the layered substrate 20, such as one in which the dielectric layers are formed of a resin, ceramic, or a resin-ceramic composite material. However, a low-temperature co-fired ceramic multilayer substrate, which is excellent in high frequency response, is particularly preferable as the layered substrate 20.

In the second embodiment, only the resonators 4 and 6 of the three resonators 4, 5 and 6 include the inductors 11 and 13 each formed of the resonator-forming conductor layers of the first type and the second type that are interdigital-coupled to each other. According to the second embodiment, it is possible to increase the Qs of the inductors 11 and 13 and consequently increase the Qs of the resonators 4 and 6, compared with a case in which the inductors of the resonators 4 and 6 are each formed only of a single resonator-forming conductor layer.

In the second embodiment, the resonator 5, which is other than the resonators 4 and 6 that include the resonator-forming conductor layers of the first type and the second type as described above, includes the through-hole type inductor 12 formed using the through holes provided within the layered substrate 20. Compared with an inductor formed only of a single resonator-forming conductor layer, the through-hole type inductor has a larger surface area and consequently has a higher Q. Accordingly, the second embodiment provides a higher Q for the inductor 12, and consequently provides a higher Q for the resonator 5, compared with a case in which the inductor of the resonator 5 is formed only of a single resonator-forming conductor layer.

If all of the resonators 4, 5 and 6 each include the resonator-forming conductor layers of the first type and the second type that are interdigital-coupled to each other, the inductive coupling between the resonators 4 and 5 and the inductive coupling between the resonators 5 and 6 become too strong. In contrast, according to the second embodiment, only the resonators 4 and 6 of the three resonators 4, 5 and 6 each include the resonator-forming conductor layers of the first type and the second type that are interdigital-coupled to each other, and the other resonator 5, which is inductively coupled to the resonators 4 and 6, does not. Consequently, according to the second embodiment, the inductive coupling between the resonators 4 and 5 and the inductive coupling between the resonators 5 and 6 are each weaker than in the case where all of the resonators 4, 5 and 6 each include the resonator-forming conductor layers of the first type and the second type that are interdigital-coupled to each other.

According to the second embodiment, in particular, the direction of travel of electromagnetic waves in the inductors 11 and 13 of the resonators 4 and 6 and the direction of travel of electromagnetic waves in the inductor 12 of the resonator 5 are orthogonal to each other. This serves to further weaken the inductive coupling between the resonators 4 and 5 and the inductive coupling between the resonators 5 and 6.

Consequently, the second embodiment makes it possible to prevent the inductive coupling between every adjacent resonators from becoming too strong with miniaturization of the electronic component, while preventing reductions in Qs of all the resonators. Furthermore, the second embodiment facilitates reductions in size and thickness of the electronic component 1, because the embodiment allows a reduction in magnitude of the inductive coupling between every adjacent resonators even in the case where the distance between every adjacent resonators must be reduced with reductions in size and thickness of the electronic component 1.

In the second embodiment, as in the first embodiment, the electronic component 1 is designed to function as a bandpass filter having a passband of, for example, approximately 2.4 to 2.5 GHz. The remainder of configuration, function and effects of the second embodiment are similar to those of the first embodiment.

The present invention is not limited to the foregoing embodiments but can be carried out in various modifications. For example, in the case where the electronic component 1 includes three resonators 4, 5 and 6 as in the foregoing embodiments, any one of the three resonators, such as the resonator 4 or the resonator 6, or any two of the three resonators, such as the resonators 4 and 5 or the resonators 5 and 6, can include the resonator-forming conductor layers of the first type and the second type that are interdigital-coupled to each other. The electronic component of the present invention can include any plural number of resonators, such as two, or four or more. According to the present invention, at least one, but not all, of the plurality of resonators includes the resonator-forming conductor layers of the first type and the second type. Consequently, there inevitably exists a portion in which the at least one resonator that includes the resonator-forming conductor layers of the first type and the second type is adjacent to another one that does not include such two types of resonator-forming conductor layers. In this portion, it is possible to make the inductive coupling between the resonators weaker than in the case where two resonators that each include the resonator-forming conductor layers of the first type and the second type are adjacent to each other.

In the present invention, the number of the resonator-forming conductor layers of the first type and the second type may be one each, or two or more each.

In the present invention, at least one of the resonators, other than the at least one that includes the resonator-forming conductor layers of the first type and the second type, may include an inductor formed of a resonator-forming conductor layer of one of the two types, instead of the through-hole type inductor.

The electronic component of the present invention is applicable not only to a bandpass filter but also to any electronic component including a plurality of resonators.

The electronic component of the present invention is useful as a filter, or a bandpass filter, in particular, for use in a communication apparatus conforming to the Bluetooth standard or a communication apparatus for use on a wireless LAN.

It is apparent that the present invention can be carried out in various forms and modifications in the light of the foregoing descriptions. Accordingly, within the scope of the following claims and equivalents thereof, the present invention can be carried out in forms other than the foregoing most preferred embodiments.

What is claimed is:

1. An electronic component comprising: a layered substrate including a plurality of dielectric layers stacked; and a plurality of resonators provided within the layered substrate such that every adjacent two of the resonators are inductively coupled to each other, wherein:

at least one, but not all, of the plurality of resonators includes a resonator-forming conductor layer of a first type and a resonator-forming conductor layer of a second type that each have a short-circuited end and an open-circuited end, relative positions of the short-circuited end and the open-circuited end being reversed between the first and second types;

the resonator-forming conductor layers of the first type and the second type are arranged to be adjacent to each other in a direction in which the plurality of dielectric layers are stacked; and at least one of the plurality of resonators, other than the at least one that includes the resonator-forming conductor layers of the first type and the second type, includes a through-hole type inductor formed using at least one through hole provided within the layered substrate.

2. The electronic component according to claim 1, wherein:

the plurality of resonators include a first resonator, a second resonator and a third resonator;

the second resonator is adjacent to and inductively coupled to each of the first resonator and the third resonator; and of the first, second and third resonators, only the second resonator includes the resonator-forming conductor layers of the first type and the second type.

3. The electronic component according to claim 1, wherein:

the plurality of resonators include a first resonator, a second resonator and a third resonator;

the second resonator is adjacent to and inductively coupled to each of the first resonator and the third resonator; and of the first, second and third resonators, only the first and third resonators each include the resonator-forming conductor layers of the first type and the second type.

4. The electronic component according to claim 1, wherein each of the plurality of resonators is a quarter-wave resonator having a short-circuited end and an open-circuited end.

5. The electronic component according to claim 1, further comprising an input terminal and an output terminal disposed on a periphery of the layered substrate, wherein the plurality of resonators are located between the input terminal and the output terminal in terms of circuit configuration, and function as a bandpass filter.

6. An electronic component comprising: a layered substrate including a plurality of dielectric layers stacked; and a plurality of resonators provided within the layered substrate such that every adjacent two of the resonators are inductively coupled to each other, wherein:

each of the plurality of resonators includes an inductor;

the inductor of at least one, but not all, of the plurality of resonators is formed of a resonator-forming conductor layer of a first type and a resonator-forming conductor layer of a second type that each have a short-circuited end and an open-circuited end, relative positions of the short-circuited end and the open-circuited end being reversed between the first and second types;

the resonator-forming conductor layers of the first type and the second type are arranged to be adjacent to each other in a direction in which the plurality of dielectric layers are stacked; and a direction of travel of an electromagnetic wave in the inductor of the at least one of the plurality of resonators and a direction of travel of an electromagnetic wave in the inductor of another one of the plurality of resonators that is adjacent to the at least one of the plurality of resonators are orthogonal to each other.

7. The electronic component according to claim 6, wherein:

the plurality of resonators include a first resonator, a second resonator and a third resonator;

the second resonator is adjacent to and inductively coupled to each of the first resonator and the third resonator; and of the inductors of the first, second and third resonators, only the inductor of the second resonator is formed of the resonator-forming conductor layers of the first type and the second type.

8. The electronic component according to claim 6, wherein:

the plurality of resonators include a first resonator, a second resonator and a third resonator;

the second resonator is adjacent to and inductively coupled to each of the first resonator and the third resonator; and of the inductors of the first, second and third resonators, only the inductors of the first and third resonators are each formed of the resonator-forming conductor layers of the first type and the second type.

9. The electronic component according to claim 6, wherein the inductor of the other one of the plurality of resonators that is adjacent to the at least one of the plurality of resonators is a through-hole type inductor formed using at least one through hole provided within the layered substrate.

10. The electronic component according to claim 6, wherein each of the plurality of resonators is a quarter-wave resonator having a short-circuited end and an open-circuited end.

11. The electronic component according to claim 6, further comprising an input terminal and an output terminal disposed on a periphery of the layered substrate, wherein the plurality of resonators are located between the input terminal and the output terminal in terms of circuit configuration, and function as a bandpass filter.

* * * * *